US005210988A

United States Patent [19]

Shaifer

[11] Patent Number: 5,210,988

[45] Date of Patent: May 18, 1993

[54] GRIDBEAM

[76] Inventor: Donald R. Shaifer, 3171 Loma Verde Pl., Palo Alto, Calif. 94303

[21] Appl. No.: 670,064

[22] Filed: Mar. 15, 1991

[51] Int. Cl.[5] ..... E04C 3/10

[52] U.S. Cl. ..... 52/223.7; 52/86; 52/228

[58] Field of Search ..... 52/227, 86, 89, 79.2, 52/79.9, 228, 229, 223 L, 585

[56] References Cited

U.S. PATENT DOCUMENTS

| | | | |
|---|---|---|---|
| 723,163 | 3/1903 | Knochenhauer . | |
| 1,723,284 | 8/1929 | Imshenetsky et al. . | |
| 2,665,387 | 1/1954 | Bartow | 52/227 |
| 2,877,877 | 3/1959 | Davis, Jr. . | |
| 3,173,226 | 3/1965 | Solnick . | |
| 3,369,334 | 2/1968 | Berg . | |
| 3,824,754 | 7/1974 | Fatosme . | |
| 3,861,100 | 1/1975 | Fastosme et al. | 52/227 |
| 3,990,203 | 11/1976 | Greenes | 52/227 |
| 4,086,737 | 5/1978 | Byrd, Jr. | 52/227 |
| 4,118,905 | 10/1978 | Shelley | 52/79.2 |
| 4,145,854 | 3/1979 | Radahl et al. | 52/228 |
| 4,161,089 | 7/1979 | Omanski . | |
| 4,294,051 | 10/1981 | Hughes, Jr. | 52/228 |
| 4,304,079 | 12/1981 | Thorsten | 52/227 X |
| 4,324,037 | 4/1982 | Grady, II | 52/229 X |
| 4,429,499 | 2/1984 | Kato | 52/228 |

*Primary Examiner*—Richard E. Chilcot, Jr.
*Assistant Examiner*—Kien Nguyen
*Attorney, Agent, or Firm*—Morrison & Foerster

[57] ABSTRACT

A modular construction system made up of a plurality of abutting orthogonal grids having a substantial section height and tensioning rods passing between abutting grids. The rods are located at the bottom third of the section height when spanning supports and in the top third when cantilevering grids off of supports.

7 Claims, 6 Drawing Sheets

GRIDBEAM

BACKGROUND OF THE INVENTION

1. Field of the Invention

This invention relates to building structures. More particularly, it concerns a modular construction system, especially one which can serve to form load-bearing horizontal surfaces such as floor or roofs.

2. Prior Art

Typically, modern-day building processes are a set of loosely organized but highly interrelated operations. A simple residential or commercial structure consists of tens of thousands of individual pieces. The number, complexity, and variety of these pieces highly impact both the design and the construction processes.

In the design, each component must be drawn, detailed and specified. This design takes a large amount of time. With a large number of elements, the interactions among them become almost overwhelming. Moreover, the responsibilities and liabilities for lack of integration of any element in the design are enormous.

In construction, each piece must be handled in some fashion—in many cases, many times. This means that tens of thousands of small operations are involved in the construction process. The net result of this is that the resultant building is both labor- and material-intensive.

Because of the number and variety of operations, the labor involved must have various levels of skill and must be supervised to a large extent.

Another problem with current construction methods is that there is a heavy dependence on the use of heavy parts to carry structural loads. Generally these heavy parts may be heavy timbers, trusses, steel beams, or concrete structures. These part require special machinery to build, special vehicles to deliver, and special equipment to erect. This leads to heavy dependent on heavy equipment such as cranes, forklifts, and special trucks. This heavy equipment use can give rise to liability, can complicate the planning and implementation of a sequential build process, and, in many cases, may be especially difficult because of limitations of the site which make it difficult or unsafe to use heavy equipment.

These difficulties with conventional modern construction processes has led to the development of quite a number of modular construction systems. These systems are characterized by prefabricating certain elements of the building, typically off-site, so that on-site construction can be speeded and carried out with a minimum of difficulty.

Representative disclosures in the patent literature to preframed or prefabricated construction components include, for example, U.S. Pat. No. 723,163, issued Mar. 7, 1903, to Gustav Knochenhauer, Which is directed to a preformed frame structure for horizontal hot beds, forcing-frames, and the like. U.S. Pat. No. 1,723,284, issued Aug. 13, 1929, to Michael Imshenetsky, relates to a modular form structure for building construction in which a plurality of surfacing members are secured into a surface and then the surface is overlaid with cement. In this system the various surfacing members are held in alignment by a series of clamps and tensioning rods.

In U.S. Pat. No. 2,877,877, issued on Mar. 17, 1959, to Hugh Davis, a modular system is provided for constructing metallic panel walls. In this system preformed modular panels are arranged and held together by corner brackets and by a prefabricated latch-together frame system. More directly in point to the present invention, U.S. Pat. No. 3,173,226, issued on Mar. 16, 1965, to Abraham Solnick, discloses a method for unitary construction of floors and roofs wherein standardized units of precast concrete are assembled together with reinforcing steel rods and channels in interlocking relationship to form a floor or roof of any designated size, shape or strength.

U.S. Pat. No. 3,369,334, issued Feb. 20, 1968, to Ralph Berg, discloses a building system which uses preformed, reinforced concrete structural units adapted to be joined together under pressure for the erection and construction of buildings, bridges and the like. This system uses a series of reinforcing rods and special connectors to effect fabrication. Turning to U.S. Pat. No. 3,824,754, issued on Jul. 23, 1974, to Albert Fatosme et al., another prefabricated building structure made of standardized components is shown. This system is based upon a premade metal framework into which standardized planks are inserted to give rise to a modular floor structure. Another example of prior work is seen in U.S. Pat. No. 4,161,089, issued Jul. 17, 1979, to Martin Omansky. This patent shows a modular building structure system for forming vertical walls, particularly useful for building handball or racketball courts, or other like sporting structures. Another example of a modular system is shown in U.S. Pat. No. 4,294,051, issued Oct. 13, 1981, to William Hughes. This system employs a multiplicity of like panels secured to several parallel pairs of internal transverse members which define an internal horizontal passage from one edge of the panel to the other such that, in assembled relationship, the passages of adjacent panels are in alignment. In addition, the panels may be held together with metal cables or rods which pass through the aligned passages in the panels and are anchored to each end of the constructed surface. While all of these representative prior efforts are excellent examples of attempts made to bring modular construction into the construction field, they, as a group, illustrate the diversity of approaches that have been considered to attempt to resolve and reduce the complexity of construction.

As will be appreciated, the difficulties of forming prefabricated horizontal surface, such as roofs and floors, is substantially greater than the difficulty surrounding the prefabrication of vertical surfaces, such as walls. This is brought about by the fact that horizontal surfaces tend to be load-bearing and tend to be in the form of spans supported only periodically.

One objective of this invention to provide a new modular design which lends itself to prefabrication and to ready assembly into horizontal surfaces.

Another objective of this invention to provide horizontal surfaces formed from a plurality of these modules and to provide an integrated horizontal surface made up of a plurality of these modules with suitable connecting means.

An additional objective of this invention to provide a means of constructing horizontal surfaces using these components.

STATEMENT OF THE INVENTION

A new and improved system for modular construction has now been developed. This system is characterized by being made up of a plurality of modular panel units (also referred to as "grid units"). These panel units are rectangular in shape. (The term rectangular is used generically to include square shapes as well.) The grid units are further characterized by having a four-sided box frame of substantial height with a top panel affixed thereto so as to give a closed-top, open-bottomed square box configuration. The units contain apertures on each side which are positioned so that when the units are assembled into the horizontal load bearing surface, the apertures align with one another to give rise to a linear passage from one unit to the other. In use, threaded joining rods pass through the apertures, and using coupling nuts, serve to join the units tightly against one another so as to provide suitable continuous tensioning. There are two sets of apertures on the side walls of the box frame, and these allow tensioning rods to pass through the grid unit and provide continuous (but segmented) tensioning: one set of apertures is one-third the distance of the side wall height from the bottom, the other set is one-third the distance from the top. When the units are assembled to span between supports, the apertures located one-third of the distance from the bottom are used for the tension rods. When the units are assembled to cantilever off of a support point, the apertures located one-third of the way from the top are used.

The ability to have continuous tensioning in either direction (along the X, Z planes) in both span and cantilever, made up of modular, but joined tension members, allows a load-bearing platform framework to be built incrementally. Thus, in one aspect this invention provides the individual modular panel units which are adapted for use in constructing the horizontal, load-bearing surface in a building. These panel units are made up of a four-sided box frame having two pairs of parallel solid walls of equal and substantial height with adjacent walls joined to one another to give four orthogonal corners and yield a rectangular frame having a rectangular top surface and a rectangular bottom surface. The unit additionally includes a rectangular top panel corresponding in dimensions to the perimeter of the box frame and affixed to the top surface of the box frame. This yields a rigid closed-top, open-bottom, rectangular box of substantial height. The unit additionally includes a plurality of apertures in each pair of parallel walls. These apertures are located at about one-third and about two-thirds of the substantial height of the walls from the bottom surface and they are positioned on the walls so as to define passages perpendicular to the pair of walls in which they are located and parallel to the pair of walls adjacent thereto.

In a preferred configuration, the modular unit is square in shape and typically about four feet by four feet in top panel dimensions and from about twelve inches to about twenty-four inches in height.

One intention of this invention is to provide a modular-constructed horizontal load-bearing surface capable of spanning between adjacent support columns to which this modular beam is affixed. This surface is made up of a plurality of the modular units just described. The units are disposed in successive abutting relationship such that the apertures in adjacent units align to define linear passages through the plurality of modular units. These units are held in a post-tensioned relationship to one another as a rigid span between any two support columns. This is done by using at least one threaded joining rod passing through at least one of the linear passages formed from apertures located about one-third of the substantial height of the wall from the bottom surface. This joining rod is equipped with threaded coupling nuts on opposite sides of each pair of abutting walls of adjacent units. These threaded coupling nuts are tightened against one another thereby joining adjacent units into the desired post-tensioned abutting relationship with one another.

Additionally, this invention provides a horizontal surface made up as just described but additionally containing additional modular units disposed in successive abutting relationship with the units creating the rigid span. These additional units are cantilevered from the ends of the span such that the apertures in adjacent units align to define linear passages through the additional modular units and the span. These cantilevered additional units are held in place by at least one threaded joining rod passing through at least one of the linear passages formed from apertures located about one-third of the substantial height of the wall from the top. Again, these threaded rods include threaded joining nuts on opposite sides of each pair of abutting walls on each pair of adjacent units. These threaded joining nuts are tightened against each other, thereby joining these additional units into a post-tensioned relationship with the span-creating units and creating a rigid extension cantilevered out from the support column.

A special column capital made up of a reinforced grid unit (with the same dimensions as other grid units already mentioned) is able to connect grid units in either spanning direction and able to provide continuous tensioning through its width. This capital also serves to integrate the horizontal spanning capability of the grid-beam platform system with the vertical load-bearing capability of the columns.

With the above described reinforced grid units forming the span between the columns in either (X,Z) direction and forming cantilevered projections from the columns in either (X,Z) direction, the remaining horizontal surface is made up of non-reinforced grid units that are similar to the post-tensioned, reinforced grid units, except they don't have tensioning rods passing through them and may not have reinforced corners. These non-reinforced grid units are joined to the reinforced grid units by corner fastenings, side wall fastenings, or the like. The combination of the reinforced and non-reinforced grid units completes the floor (or ceiling) framework.

DETAILED DESCRIPTION OF THE INVENTION

1. Brief Description of the Drawings

This invention will be further described with reference to the accompanying drawings. In these drawings the same reference numerals are used throughout for the same items.

Figure 5:
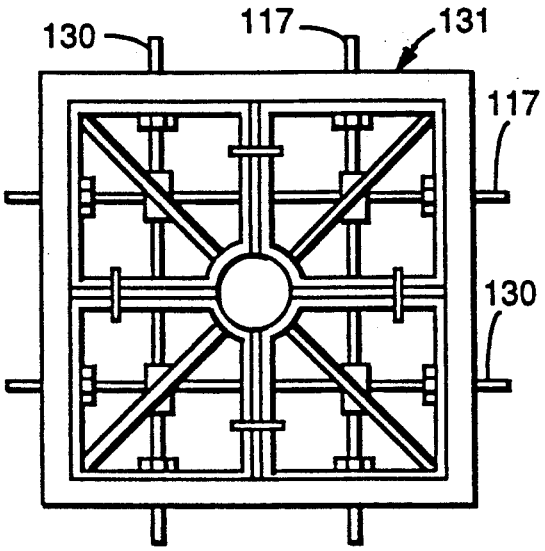

FIG. 5 is one embodiment of a column capital grid unit with a reinforced inner structure. This structure itself sits on ring cleat and can be clamped around the column via the bolts that connect the sections of the inner structure. This capital can also receive tensioning rods from any of the four directions, and from either of the two sets of apertures, similar to the ones shown in FIG. 6.

Figure 6:
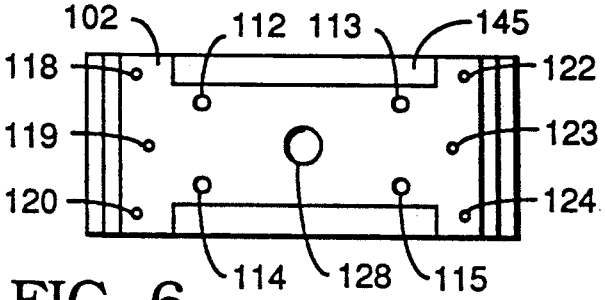

FIG. 6 is an elevation view of a side wall shown in FIGS. 1, 2, 3 and 4.

Figure 7:
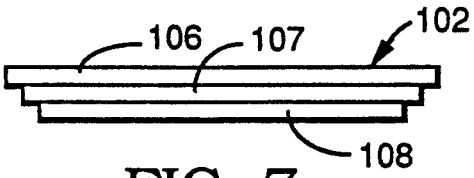

FIG. 7 is a horizontal cross-section of a side wall.

Figure 8:
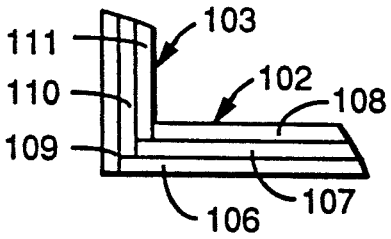

FIG. 8 is a detail of a typical corner of the grid unit shown in FIGS. 1 through 5, where the step-joints on each side wall fits into the corresponding step-joints of the other two abutting side walls. In a grid of four side walls, these joints are staggered so that only one end of each side wall is on the extreme corner of the grid unit.

Figure 9:
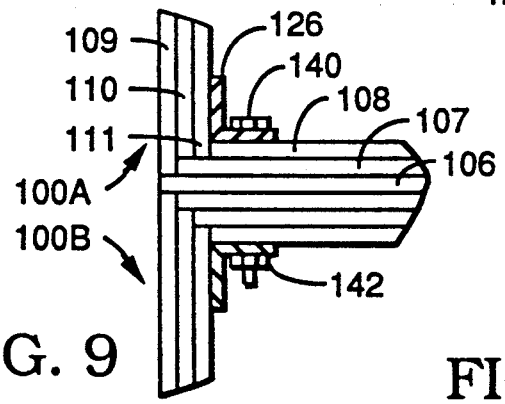

FIG. 9 shows a detail of the corners of two adjacent grid units that are joined by corner brackets and bolts. In this detail, the stagger of the step joints is alternated.

Figure 10:
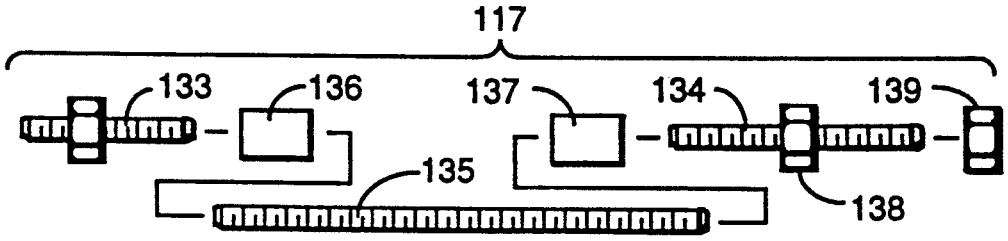

FIG. 10 is an exploded view of a preferred form of joining rod.

Figure 11:
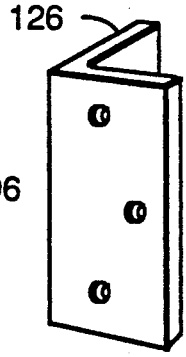

FIG. 11 is a is a typical reinforcing corner bracket.

Figure 12:
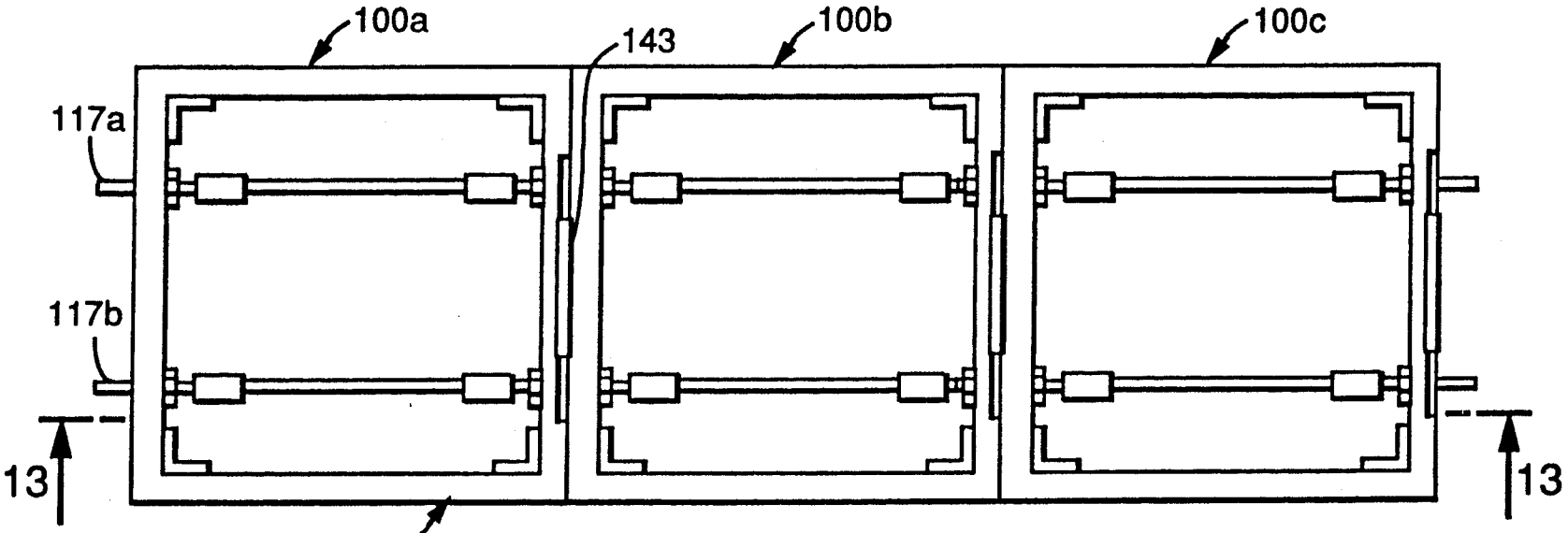

FIG. 12 is a more detailed horizontal cross-sectional view of a plurality of grid units affixed together with joining brackets and joining rods.

Figure 13:
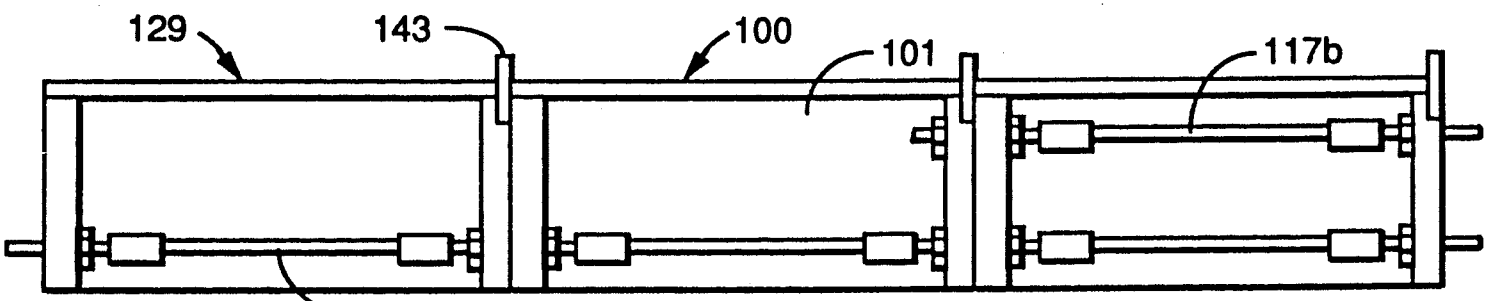

FIG. 13 is a vertical cross-section of the group of grid units shown in FIG. 12, showing placement of the joining rods.

Figure 14:
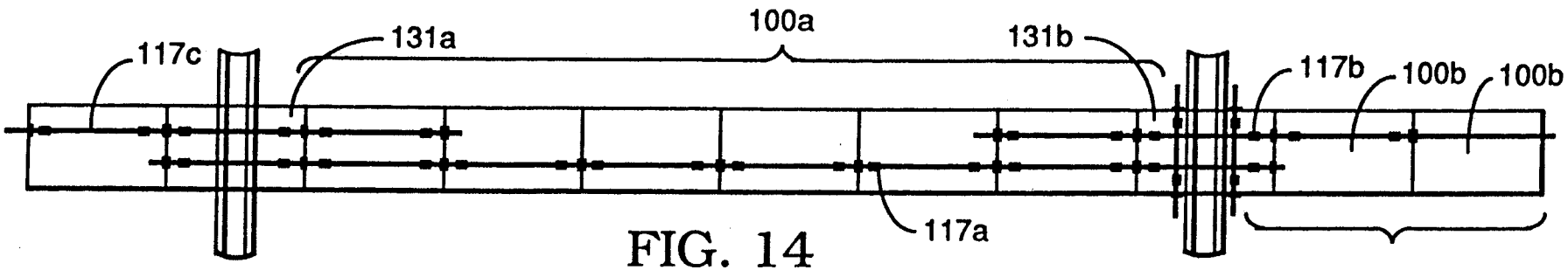

FIG. 14 is a schematic vertical cross-section side view of a floor surface having a span constructed of grid units as well as two cantilevered sections formed by grid units; this shows the placement of joining rods in both conditions (of span and cantilever).

Figure 15:
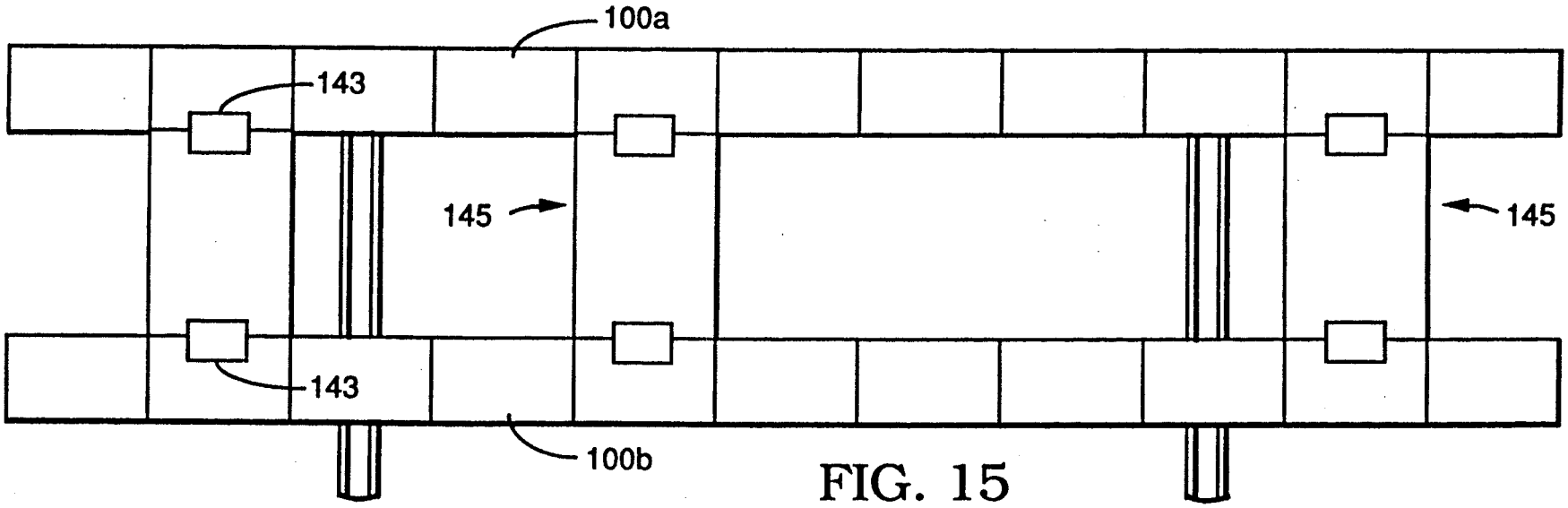

FIG. 15 shows parallel spans that are joined together in a multi-story configuration by means of columns and interior panels. These panels, in turn, are connected to the grid beam by means of panel tabs. This allows the walls to act as shear walls at any point along the grid. It also means that the two indpendnet beams become integrated into one "deep beam" which further increases the beam strength.

Figure 16:
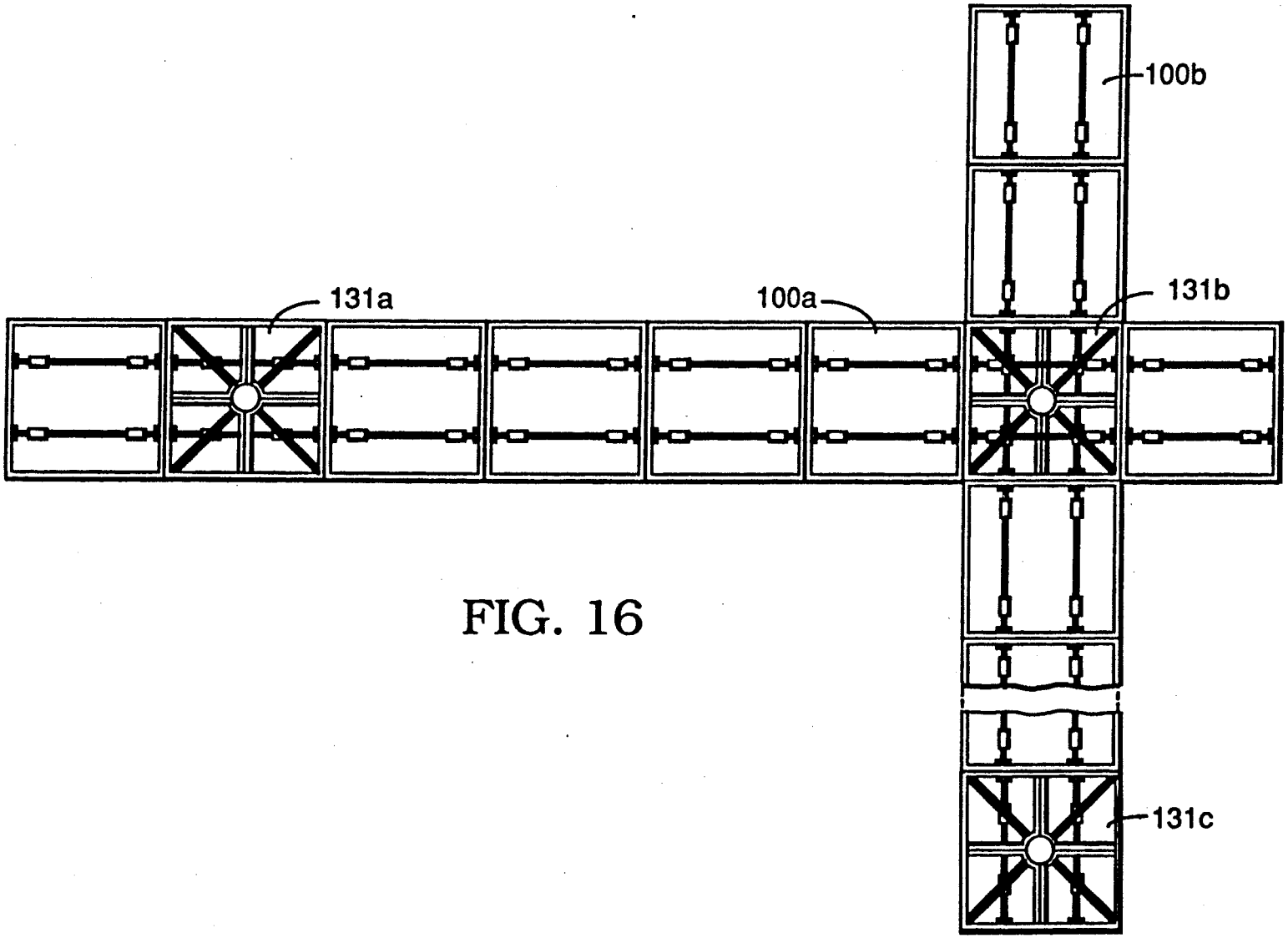

FIG. 16 is a schematic view showing in horizontal cross-section a typical arrangement of grid units formed into spans and cantilevers in two orthogonal (X,Z plane) direction.

Figure 17:
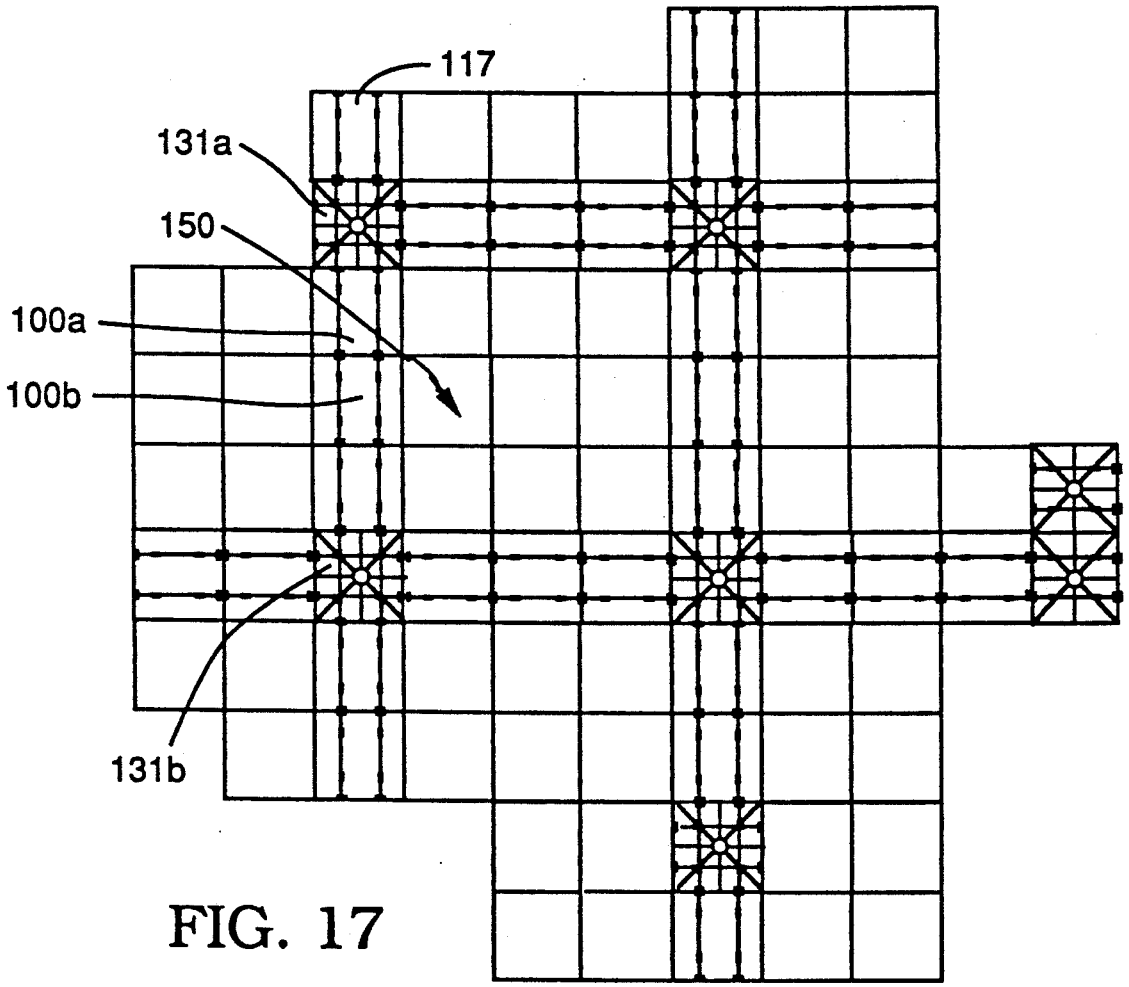

FIG. 17 is a schematic view showing a combination of reinforced grid units (i.e., those containing joining rods) and additional units that are not reinforced; together, this combination produces a large geometrically diverse floor surface.

2. Description of Preferred Embodiments

The present invention provides a modular construction system for forming load-bearing horizontal surfaces, particularly floor surfaces. This system, promoted under the tradename GRIDBEAM, is the structural part of a modular solution for design and building. The gridbeam system is the primary framework which organizes and facilitates the construction of all other systems in the building. Along with the gridbeam horizontal construction system, the systems are a column system for supporting the gridbeam, all vertical systems (walls, doors, stairs, closets, etc.) and various mechanical systems such as plumbing, electrical and air conditioning. When these systems are assembled, they constitute all the elements to build complete residential or commercial structures.

As a unified solution, the construction system of this invention has the explicit criteria of reducing the number, complexity, and variety of parts and operations through the use of a systems approach, thereby providing high quality construction. The entire design approach is to resolve the structure and its details into very simple components and operations.

The basic horizontal platform provided by this invention consists of a few extremely basic and easily manufactured pieces. These pieces are joined together to quickly form the fundamental horizontal surface. In this system, the most fundamental unit, the grid unit, consists of the same one part, the cell wall, used four times.

Referring to FIGS. 1, 2, 3 and 4, four views of the grid unit are shown.

Figure 1:
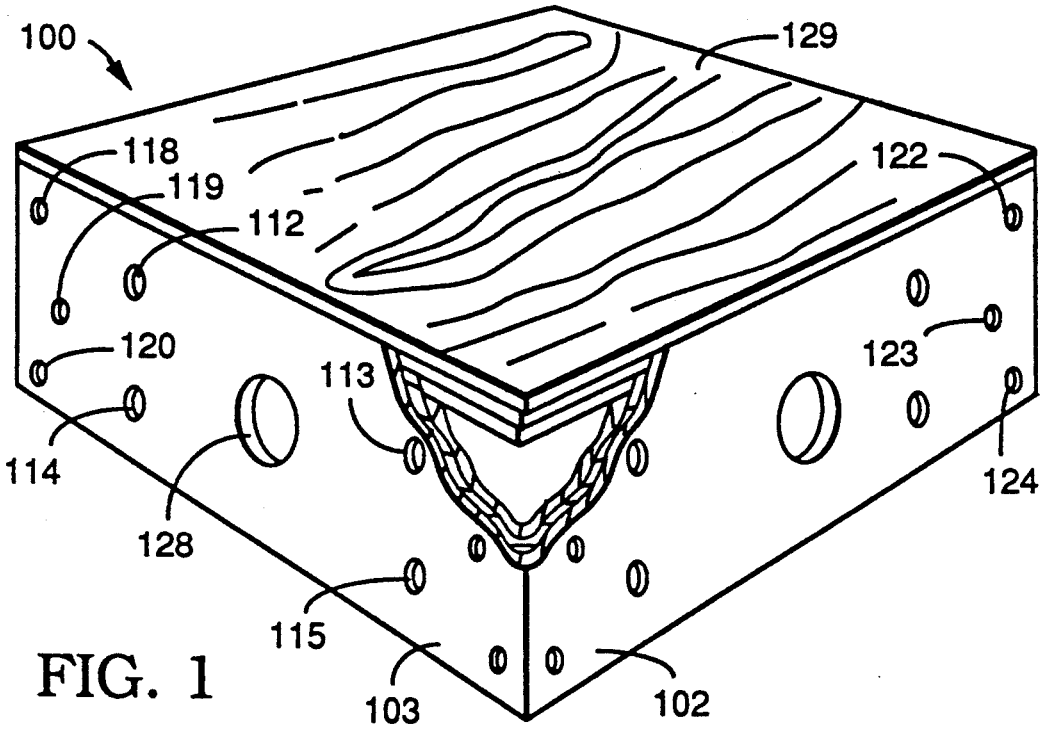
FIG. 1 is a partially cut-away perspective view of a grid unit of the invention.
Figure 2:
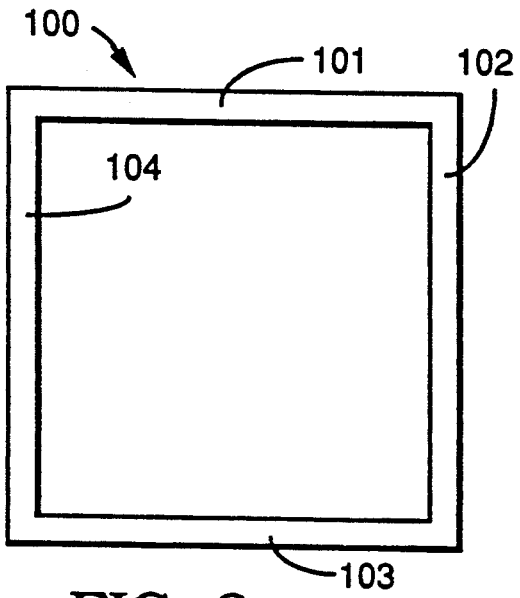
FIG. 2 is a top view of a non-reinforced grid unit.
Figure 3:
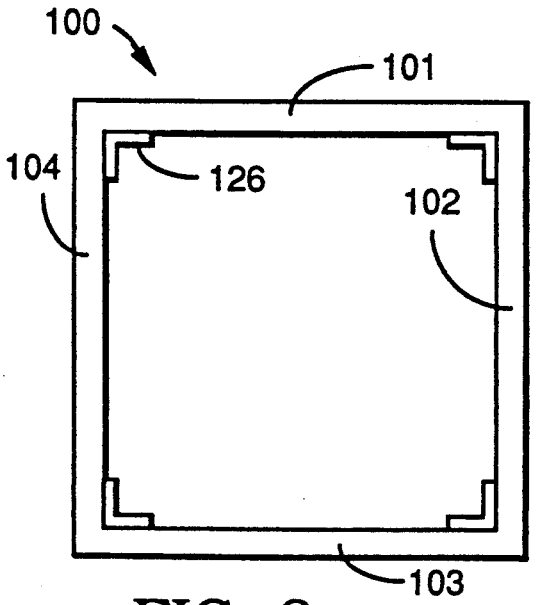
FIG. 3 is a top view of a grid unit with reinforced corners.

The grid unit 100 has four vertical walls (101, 102, 103 and 104 in FIG. 2, for example). These four walls are arranged orthogonally to give a rectangular shape, i.e., a shape with square corners. As shown in FIGS. 1 to 4, the preferred shape for the grid unit 100 is square, with the typical length of each wall being approximately four feet. Side walls, as shown in FIGS. 6 and 13 as 101, have a substantial height. That is, they are at least one foot high, and up to two feet high, with the preferred height being somewhere in between. As a rule of thumb, the height of the side wall 101, etc., is at least 1/16th to 1/20th of the span ultimately constructed between adjacent support columns.

The grid unit shown in the figures is typically constructed out of plywood. In the embodiment shown in FIGS. 1, 7, 8 and 9, the side walls such as 101 are made out of three layers (106, 107 and 108, or 109, 110 and 111) of approximately ¾-inch plywood laminated together. As can be seen in FIGS. 7, 8 and 9, these pieces are typically joined together in a step-joint at their corners. Alternatively, butt joints or any other form of making this corner may be used. Also, other materials may be used.

All the side walls in FIGS. 1 and 6 contain a variety of apertures, and these are the same from side wall to side wall. Two of these apertures (112 and 113 in FIG. 1) are located ⅓ of the substantial height from the top, and another two (114 and 115 in FIG. 1) are ⅓ of the substantial height from the bottom. These apertures are approximately one inch in diameter, and it is these through which the tensioning rods such as 117 pass. When the grid units are joined together in span, the lower (114 and 115 in FIG. 1) apertures are used for continuous tensioning, and when the grid units are used in cantilever, the top apertures (112 and 113 in FIG. 1 are used.

The grid unit also includes some additional apertures (for example, 118, 119, 120, 122, 123, 124, etc. in FIGS. 1 or 6), located near the corners of the side wall. These are used for affixing reinforcing brackets and for joining abutting grid units together at their corners as shown in FIG. 9. These reinforcing brackets (such as 126 in FIGS. 3, 9 or 11) are typically used to reinforce the corners of those grids through which tensioning rods 117 pass (as shown in FIG. 4).

These apertures are accurately positioned so as to define a plurality of parallel passages perpendicular to the walls in which they occur. These passages are positioned so that when a plurality of units are abutted to one another in alignment, line-of-sight passages may be seen through the plurality of units. The grid unit also includes some additional apertures, (for example 118, 119 and 120 in FIG. 1 etc. located near their corners which are designed for affixing reinforcement brackets 126 such as the reinforcement bracket shown in FIG. 11 as 126 or for otherwise joining abutting units. These reinforcement brackets are typically used to reinforce the corners of those grid units through which the tensioning rods pass. The grid units may also include additional apertures represented by aperture 1 in FIG. 1 or FIG. 6, for example, through which electrical service, plumbing service or the like may pass.

The grid unit 100 additionally contains a top panel (129 in FIG. 1). As shown in FIG. 1, this panel can be formed using plywood or other material to provide sufficient strength for bearing purposes. Top 129 (in FIG. 1) is sized to fit on top of the four walls and to give perimeter dimensions corresponding to the size and shape defined by the four walls.

Figure 4:
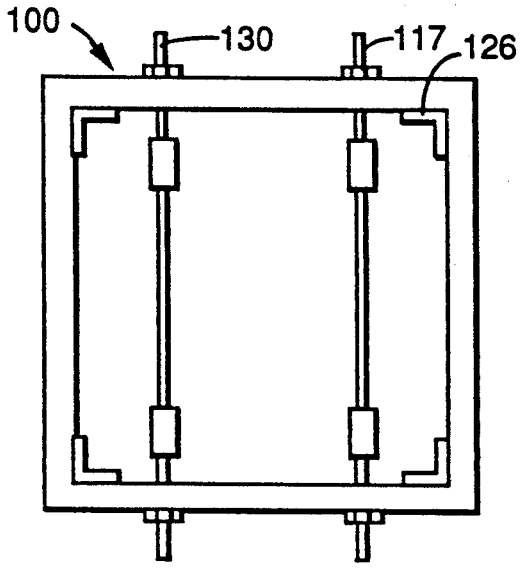
FIG. 4 is a reinforced grid unit with modular tension rods.

As shown in FIG. 4, a grid unit may have one or more joining bars, tensioning rods or joining rods (117 and/or 130) passing through them via, for example, apertures 112 and 113 in FIG. 1). As shown in FIGS. 12 and 13, the joining rods 117 (shown in exploded view in FIG. 10) can couple together a plurality of grid units for example, 100*a*, 100*b* and 100*c* in FIG. 12 etc. The assembly in FIG. 16 includes column units (131*a*, 131*b* and 131*c*) which are spanned by a plurality of grid units (100*a*, etc.). Additional grid units (100*b*) are cantilevered off the ends of columns by means of the joining rods 117 as shown in FIG. 14.

Thus these grid units are assembled into a hybrid of a post and beam construction system. In this system, segmented beams span and cantilever across sets of columns. The vertical portion of this structural system is a corresponding column system to which grid beam is integrated. These same columns which support the floor can also serve to support ceilings, roof systems and the like. These columns constitute the vertical support between floors and the foundation as well. No other foundation is required for many designs. These columns may be concrete, steel or wood.

The system of this invention along with the column system forms a universal foundation not restricted to a particular region, climate or condition. It can perform well in a wide variety of soil and geological conditions. Having a column-based foundation means the placement and number of columns is determined by site conditions but will not change the grid system. If the soil conditions are poor or if the site is in a high seismic activity zone, the design might call for more closely placed columns than in more favorable environments.

Turning to FIGS. 6, 10, 12 and 13, a more detailed description of the joining together of multiple units is shown. The grid beam is made up of three units, (100*a*, 100*b* and 100*c* in FIG. 12). Each of these units is substantially as shown in FIG. 1. The units are assembled in abutting relationship to one another so that they align to give a parallel wall (132, for example in FIG. 12). Through rods or joining rods (117*a* and 117*b* in FIGS. 10, 12 or 13) pass through the apertures (not shown) (114 and 115 in FIG. 6) located in each of the units. As can be seen in FIG. 13 the joining rod 117*a* is going through the units at a height approximately one-third of the distance from the bottom of the unit. This is a configuration characteristic of units which are spanning between two columns. The tensioning rod or joining rod 117 is typically a threaded rod and can for simplicity be a single-piece rod running through the plurality of units. Preferably, for ease of construction, tension rods 117 are made segmented as shown in FIG. 10 so as to include through rods 133 and 134, intermediate rod 133 and threaded couplings 136 and 137. The through rods 10*b*, for example, pass between a pair of units. Threaded nuts 138 and 139 are on opposite sides of this pair of abutting walls and are tightened against each other to compress the two units into tight abutment. Intermediate rod 135 and couplings 136 and 137 serve to join together adjacent through rods into a continuous unit. This allows easy construction on site. One method of construction connects the grid units together using the connecting rods 117 (shown in FIG. 10) to tension each successive unit as it is put in place. This is done by the tightening the the nuts on the inside surface of the grid closest to the already installed grid, but not the nuts distant. That way, the tensioning is always maintained towards the end of the beam (i.e., away from the middle) as it is being constructed. In this construction, the threads on the rods and connectors can be run in the same direction. Also, this means that the tensioning is "incremental" as opposed to collective in conventional beams.

Another construction method uses the turnbuckle principle, where one or more of the couplings and their associated rods are half-reverse threaded so that tightening in one direction will draw rods together in tension. As shown in FIG. 9, in addition to joining adjacent units 100*a* and 100*b* together with tensioning rods, bolts such as bolt 140 may be passed through corner-bracket 126 and there affixed such as by nut 142. In addition, one may apply adhesive between abutting units thereby forming an even yet more rigid beam.

Although not required to practice this invention, it is often advantageous to include additional features in this beam construction to facilitate the construction of vertical walls and the like. For example, as shown in FIGS. 12 and 13, a tab-plate (143 in FIGS. 12 and 13) can be inserted into a notch in the outer surface of walls (145 in FIG. 6). This tab 143 gives a vertical extension above the floor surface to which walls (146 in FIG. 15) and the like may be attached. In FIG. 13, a top unit 129 is shown in place.

Turning now to FIGS. 13 and 14, one can see the different positioning of connecting rod 117 used when spanning between columns, for example, in units shown as 100*a* in FIG. 14 (the rod 117*a* is located of the bottom third of the vertical height of the unit) as compared to its placement in the top third of the height as 117*b* or 117*c* when it is cantilevering out units such as 100*b*. FIG. 17 shows an example of the architecturally diverse shapes which can be achieved using the system of this invention. As can be seen in FIG. 17, the reinforced grid units 100*a*, etc. with through rods 117, etc. are positioned standing and cantilevered from columns 131*a* and 131*b*, for example. In addition to these reinforced units, there are a number of non-reinforced units 150 shown in FIG. 17*d*. These units are as shown as 100 in FIG. 2. That is, they are similar if not identical to the units shown in FIG. 3, merely lacking the corner brackets shown as 126 in FIG. 3. These units 150 are typically fixed to adjacent units by the use of corner bolts, washers and nuts and adhesives if desired. These units do not necessarily contain through rods such as 117.

The construction system of the present invention offers a vast number of advantages. They can be formed of material of ready availability such as plywood or other materials which may provide lower cost. The individual components of the grid units can be manufactured to a high precision at a factory and delivered to the site for assembly. This allows for virtual 100% packing density of the individual units and thus cuts down shipping costs dramatically. In addition, the individual units when constructed weigh approximately 140 lbs. With the top removed, the weight is even lower. This allows the ready construction of a structure without the use of heavy equipment and the like. Individual grids can be emplaced by two workers with only moderate labor skill in a matter of minutes per unit.

An assembled system is an integrated unit of floor, ceiling, roof and column elements. It is the structural platform onto which the remainder of the structure is constructed. The central columns sustain all the load and all vertical panels are non-load-bearing.

In a typical construction built around the system of the invention, columns are first poured or driven to a pre-determined depth depending on site conditions, frost-depth, etc. These columns, as previously noted may be concrete, steel or wood. If concrete, they may be poured into stay-in-place-form work. The placement of the columns should be precisely done since the high quality of the construction takes advantage of this precision. Once the columns are in place, the horizontal platforms are constructed upon them.

The grid unit sidewall such as 102 shown in FIG. 6 is pre-cut and pre-drilled in a manufacturing plant. The individual grid units 100 (FIG. 1) are generated by assembling four identical grid walls 101, 102, 103 and 104 and fastening the corners with screw and glue to make rigid joints. The individual grids are then glued and bolted to one another. In addition, some of the grids receive the modular tensioning or joining bars 117. The operation is very simple and straightforward since the parts are manufactured to a high tolerance (can be within 0.005"), and parts are mated together with a self-aligning joint system to a high degree of precision. For a given grid, the entire operation requires two workers less than four minutes to produce and install a non-reinforced unit and less than six minutes to produce and install a reinforced unit.

For a typical residence of 1600 to 2000 square feet, the entire floor can be emplaced by three workers within two days. An additional amount of time is required for each ceiling, additional floor and roof system. Note that the same grid is the receptor for finished ceilings as well as finished flooring.

Once the cell walls have been constructed and joined together to give rise to the grid-beam construction, the floor panels 129 may be dropped in.

These floor panels are typically 4' by 4' units. They may be pre-finished or they may be unfinished as desired.

Although this invention has been described with particular reference being made to certain preferred embodiments, it will be understood that the invention can be modified by those of ordinary skill in the art and that its scope is as defined by the following claims.

I claim as my invention:

1. A modular-constructed, horizontal load-bearing surface spanning and resting upon at least two vertical support columns comprising a plurality of modular panel units each said modular panel unit adapted for use in constructing a horizontal, load-bearing surface in a building comprising a four-sided box frame having two pairs of parallel solid walls of equal and substantial height with adjacent walls joined to one another to give four orthogonal corners and a rectangular or square flat-top surface and bottom surface to said box frame, a rectangular or square top panel corresponding in dimensions to the perimeter of the box frame and affixed to the top surface of the box frame to give a rigid, closed-top, open-bottom rectangular or square box of substantial height with a plurality of apertures in each pair of parallel walls, said apertures being located at about one-third and about two-thirds of the substantial height of said walls from the bottom surface and positioned so as to define passages perpendicular to the pair of walls in which they are located and parallel to the pair of walls adjacent thereto, said plurality of modular panel units disposed in successive abutting relationship such that the apertures in adjacent units align to define linear passages through said plurality of modular units, and at least one threaded joining rod passing through at least one of said linear passages formed from apertures located about one-third of the substantial height of said wall from the bottom surface, said threaded joining rod having threaded coupling nuts on opposite asides of each pair of abutting walls of adjacent units tightened against one another, thereby joining adjacent units into post-tensioned relationship with one another and creating with at least a portion of said plurality of modular panel units a rigid span between two of the support columns.

2. The surface of claim 1 additionally comprising additional said modular units of claim 1 disposed in successive abutting relationship with the units creating the rigid span and cantilevered from the ends of said span such that the apertures in adjacent units align to define linear passages through said additional modular units and the span, and at lease one threaded joining rod passing through at least one of said linear passages formed from apertures located about two-thirds of the substantial height of said wall from the bottom, said threaded joining rod having threaded joining nuts on opposite sides of each pair of abutting walls of adjacent units tightened against each other, thereby joining said additional units into post-tensioned relationship with the span-creating units and creating a rigid extension cantilevered out from beyond the support column.

3. The load bearing surface of claim 2 additionally comprising internal corner brackets located inside the orthagonal corners of each of the modular units with fastening means passing through the corner brackets and walls of abutting units and affixing the two abutting units to one another.

4. The load bearing surface of claim 2 wherein abutting units are fastened to one another with adhesive.

5. The load bearing surface of claim 1 additionally comprising internal corner brackets located inside the orthagonal corners of each of the modular units with fastening means passing through the corner brackets and walls of abutting units and affixing the two abutting units to one another.

6. The load bearing surface of claim 1 wherein abutting units are fastened to one another with adhesive.

7. A modular-constructed floor comprising two or more modular-constructed, horizontal load-bearing surfaces spanning and resting upon at least two vertical support columns comprising a plurality of modular panel units each said modular panel unit adapted for use in constructing a horizontal, load-bearing surface in a building comprising a four-sided box frame having two pairs of parallel solid walls of equal and substantial height with adjacent walls joined to one another to give four orthogonal corners and a rectangular or square flat-top surface and bottom surface to said box frame, a rectangular or square top panel corresponding in dimensions to the perimeter of the box frame and affixed to the top surface of the box frame to give a rigid, closed-top, open-bottom rectangular or square box of substantial height with a plurality of apertures in each pair of parallel walls, said apertures being located at about one-third and about two-thirds of the substantial height of said walls from the bottom surface and positioned so as to define passages perpendicular to the pair of walls in which they are located and parallel to the pair of walls adjacent thereto, said plurality of modular panel units disposed in successive abutting relationship such that the apertures in adjacent units align to define linear passages through said plurality of modular units, and at least one threaded joining rod passing through at least one of said linear passages formed from apertures located about one-third of the substantial height of said wall from the bottom surface, said threaded joining rod having threaded coupling nuts on opposite sides of each pair of abutting walls of adjacent units tightened against one another, thereby joining adjacent units into post-tensioned relationship with one another and creating with at least a portion of said plurality of modular panel units a rigid span between two of the support columns;

said two or more load bearing surfaces being in parallel spaced relationship with the space between the load bearing surfaces being filled with additional of said modular units affixed to units in said surfaces in an abutting horizontal relationship.

* * * * *